US009028940B2

(12) United States Patent
Hasegawa et al.

(10) Patent No.: US 9,028,940 B2
(45) Date of Patent: May 12, 2015

(54) SHEET ROLL AND SHEET-LIKE COUPLING MEMBER

(75) Inventors: Yoshinori Hasegawa, Otsu (JP); Hiroshi Adachi, Otsu (JP); Hiroki Mori, Otsu (JP); Kaoru Mitsugi, Otsu (JP); Naohiro Ikai, Otsu (JP)

(73) Assignee: Nippon Electric Glass Co., Ltd., Shiga (JP)

( * ) Notice: Subject to any disclaimer, the term of this patent is extended or adjusted under 35 U.S.C. 154(b) by 0 days.

(21) Appl. No.: 13/182,613

(22) Filed: Jul. 14, 2011

(65) Prior Publication Data

US 2012/0015132 A1 Jan. 19, 2012

(30) Foreign Application Priority Data

Jul. 16, 2010 (JP) ..... 2010-161695

(51) Int. Cl.

| | |
|---|---|
| ***B32B 3/00*** | (2006.01) |
| ***B32B 3/06*** | (2006.01) |
| ***B32B 3/08*** | (2006.01) |
| ***F16B 5/00*** | (2006.01) |
| ***B65H 21/00*** | (2006.01) |

(52) U.S. Cl.

CPC ..... *B65H 21/00* (2013.01); *Y10T 428/197* (2015.01); *Y10T 403/76* (2015.01); *B65H 2301/46325* (2013.01)

(58) Field of Classification Search

CPC ..... B32B 3/06; B32B 3/08; B32B 3/18; B65H 21/00; B65H 2301/46325; F16B 5/00

USPC ..... 428/57, 58, 61; 206/53, 413, 393, 410

See application file for complete search history.

(56) References Cited

U.S. PATENT DOCUMENTS

| | | | | |
|---|---|---|---|---|
| 3,853,654 | A | 12/1974 | Patton | |
| 5,472,089 | A | 12/1995 | Specogna et al. | |
| 5,655,659 | A * | 8/1997 | Kennedy | 206/455 |
| 6,033,508 | A | 3/2000 | Taniguchi et al. | |
| 2011/0192878 | A1 | 8/2011 | Teranishi et al. | |

FOREIGN PATENT DOCUMENTS

| | | |
|---|---|---|
| CN | 101402423 | 4/2009 |
| JP | 07-002398 | 1/1995 |
| JP | 8-40468 | 2/1996 |
| JP | 11-054007 | 2/1999 |
| JP | 2010-132350 | 6/2010 |

OTHER PUBLICATIONS

English translation of JP 2010-132350 A.*

(Continued)

*Primary Examiner* — Maria Veronica Ewald
*Assistant Examiner* — Joanna Pleszczynska
(74) *Attorney, Agent, or Firm* — Wenderoth, Lind & Ponack, L.L.P.

(57) ABSTRACT

A sheet roll comprises two glass films and a coupling portion, wherein end portions of the glass films are coupled together via the coupling portion and the coupled glass films are rolled into a roll shape. The coupling portion is a sheet-like coupling member formed of a resin film and placed on the end portions of the two glass films in a rolling direction so as to span therebetween. The sheet-like coupling member includes wide joint portions joined respectively to the end portions of the two glass films, and a necked portion which is narrower than the wide joint portions and is formed at a middle portion of the sheet-like coupling member in the rolling direction.

10 Claims, 6 Drawing Sheets

(56) References Cited

OTHER PUBLICATIONS

International Search Report issued Aug. 16, 2011 in corresponding International (PCT) Application No. PCT/JP2011/066095.
International Preliminary Report on Patentability and Written Opinion issued Feb. 21, 2013 in International Application No. PCT/JP2011/066095.
Extended European Search Report issued Mar. 3, 2014 in corresponding European Patent Application No. 11806859.2.
Chinese Office Action issued Jun. 17, 2014 in Chinese Application No. 201180023672.9 (with English translation).

* cited by examiner

SHEET ROLL AND SHEET-LIKE COUPLING MEMBER

TECHNICAL FIELD

The present invention relates to a sheet roll formed by coupling a plurality of sheets together and rolling the coupled plurality of sheets into a roll shape, and an improvement in a coupling structure which couples end portions of the plurality of sheets included in the sheet roll together.

BACKGROUND ART

As is well-known, a sheet such as a long resin film or paper sheet which is continuously manufactured is normally rolled around a roll core into a roll shape and accommodated. In a sheet roll which accommodates the sheet in this manner, when the sheet rolled around the roll core does not satisfy a predetermined length, there are cases where a method is employed in which the sheet is kept rolled around the roll core while the leading end of another sheet is coupled to the terminal end of the sheet which is already rolled around the roll core until the entire length of the sheet reaches the predetermined length (see, e.g., Patent Document 1).

In addition, in recent years, there is developed a glass film which is reduced in thickness into a film form and, similarly to the above-mentioned sheet such as the resin film or the like, there is a growing use of a form in which the continuously manufactured long glass film is rolled around the roll core into the roll shape and accommodated (see, e.g., Patent Document 2). In this case as well, when the glass film rolled around the roll core does not satisfy the predetermined length, there are cases where the method is employed in which the leading end of another glass film is coupled to the terminal end of the glass film which is already rolled around the roll core to extend the entire length of the glass film.

In addition, there are cases where predetermined processing (e.g., washing, film formation, cutting or the like) is performed on the above-mentioned sheet roll according to what is called a Roll to Roll process. When the sheet is a brittle material such as the glass film or the like, for the purpose of preventing the breakage of the sheet made of the brittle material, there are cases where the end portion of a sheet made of a tough material such as a resin sheet or the like (in this case, the sheet is referred to as, e.g., a leader) is coupled to the end portion of the sheet made of the brittle material, and the entire sheet is guided into a device which executes the Roll to Roll process by using the terminal end of the sheet made of the tough material as the lead.

Consequently, in the sheet roll, as in the former, there are cases where the sheets of the same type are coupled together, or, as in the latter, there are cases where the sheets of different types are coupled together.

CITATION LIST

[PTL 1] JP 7-2398 A
[PTL 2] JP 2010-132350 A

SUMMARY OF INVENTION

Technical Problem

As described above, when a plurality of sheets are coupled together, it is necessary to couple end portions of adjacent two sheets in a rolling direction. As illustrated in FIGS. 9(*a*) and 9(*b*), an example of the coupling method includes a method in which, in a state where end portions of two sheets 100 are overlapped on each other, adhesive tape 101 is attached so as to extend over substantially entire widthwise areas of both of the sheets 100.

However, in this case, as illustrated in FIG. 9(*a*), when the two sheets 100 are coupled together in a state where the widthwise center lines of the two sheets 100 are not aligned on the same straight line even slightly, troubles occur when the coupled sheets 100 are rolled.

That is, as illustrated in FIG. 9(*b*), in a case where the coupled plurality of sheets 100 are rolled, when joint portions bonded to each other by the adhesive tape 101 are considered as references, tension acts on the adjacent two sheets 100 in a rolling direction on both sides of the joint portions in a direction in which the two sheets 100 are moved away from each other. When the tension acts in this manner, the misalignment of the widthwise center lines of the two coupled sheets 100 is corrected, wrinkles 102 occur around the joint portions as a result, and there can arise troubles such as meandering (in the width direction and thickness direction) or rolling displacement of the sheet 100, and damage or breakage of the sheet 100 by extension. In addition, when processing such as cutting or film formation is performed on the sheet 100 during the rolling operation of the coupled plurality of sheets 100, the occurrence of the wrinkles 102 leads to the occurrence of processing failure.

Note that such troubles can similarly occur, e.g., when the adhesive tape is attached so as to extend over entire widthwise areas or almost entire widthwise areas of both of the sheets under a state where the edges of the sheets are caused to abut against each other, or disposed in spaced apart relation.

The above-mentioned troubles can be prevented by coupling the sheets together under a state where the widthwise center lines of the sheets are completely aligned, but it is substantially impossible to couple the sheets under the state described above so that the countermeasure is not practical.

To cope with this, as illustrated in FIG. 10, it is conceivable that end portions of adjacent two sheets 100 are disposed in spaced apart relation, a thin sheet-like coupling member (hereinafter, referred to as a sheet-like coupling member) 103 is placed so as to extend over only on partial areas of widthwise central portions of both of the sheets 100, and both end portions thereof are bonded to the sheets 100 using adhesive tape 101. With this structure, an effect of absorbing deformation occurring in the sheets 100 when the misalignment of the widthwise center lines of the sheets 100 is corrected by using deformation such as torsion of the sheet-like coupling member 103 or the like should be achieved.

However, in this case, tension acting on the sheets 100 during the rolling operation is locally concentrated on the partial areas of the widthwise central portions of the sheets 100 each formed with a joint portion (area to which the adhesive tape 101 is attached) with the sheet-like coupling member 103, and hence there can arise a problem in that wrinkles 102 tend to occur around the joint portions in the end portions of the sheets 100.

In view of the foregoing, it is a technical object of the present invention to reduce a situation in which a wrinkle occurs in a sheet by tension acting during a rolling operation as much as possible in a sheet roll formed by coupling a plurality of sheets together and rolling the coupled plurality of sheets into a roll shape.

Solution to Problem

The present invention devised in order to solve the above-mentioned problem relates to a sheet roll, which is formed by coupling end portions of a plurality of sheets together via a coupling portion and by rolling the coupled plurality of sheets into a roll shape, in which:

the coupling portion is formed of a sheet-like coupling member placed on the end portions of adjacent two sheets in a rolling direction so as to span therebetween; and the sheet-like coupling member includes: wide joint portions each being joined to each of the two sheets at each of both the end portions in the rolling direction thereof; and a necked portion, which is narrower than the joint portions and is formed at a middle portion thereof in the rolling direction.

According to the above-mentioned structure, even when tension acts on the sheets during a rolling operation and misalignment of widthwise center lines of the individual sheets may be corrected, the narrow necked portion of the sheet-like coupling member actively deforms (e.g., torsional deformation), and unreasonable deformation becomes less likely to occur in the sheet itself. In addition, the sheet-like coupling member includes the wide joint portion, and hence the tension acting on each sheet acts on a widthwise wide range of the sheet end portion. As a result, there is less likely to cause a situation in which the tension locally acts only on a widthwise narrow range of the sheet end portion to thereby form a wrinkle around the joint portion. Moreover, the sheet end portion is preliminarily reinforced by the wide joint portion of the sheet-like coupling member so that the deformation is less likely to occur therein. Therefore, it is possible to reduce a situation in which the wrinkle occurs in the sheet end portion as much as possible.

The present invention devised in order to solve the above-mentioned problem relates to a sheet roll, which is formed by coupling end portions of a plurality of sheets together via a coupling portion and by rolling the coupled plurality of sheets into a roll shape, in which:

the coupling portion is integrally formed with one of the end portions of adjacent two sheets in a rolling direction; and one of the two sheets formed with the coupling portion includes: in order from a side of the end portion in the rolling direction, a wide joint portion joined to the end portion of another sheet; and a necked portion narrower than the joint portion.

That is, when the wide joint portion and the narrow necked portion are integrally formed with the one of the end portions of the adjacent sheets in the rolling direction, as described above, it is possible to obtain the same operation and effect as in the case where the end portions of the sheets are coupled together using the sheet-like coupling member which is a separate member from the sheet.

In the above-mentioned structure, it is preferred that a maximum width of the joint portion be in a range of from 80% to 100% of a maximum width of the sheet, and a minimum width of the necked portion be in a range of from 5% to 70% of the maximum width of the sheet That is, when the maximum width of the joint portion is excessively small relative to the maximum width of the sheet, the wrinkle may occur on both widthwise sides of the sheet at the point when the tension acts on the sheet. In addition, when the minimum width of the necked portion is excessively small relative to the maximum width of the sheet, the necked portion can not withstand the tension acting when the coupled sheets are rolled so that the necked portion may be torn, whereas when the minimum width thereof is excessively large relative to the maximum width of the sheet, the effect of absorbing deformation in the necked portion is lowered so that the sheet may also be deformed. Consequently, the maximum width of the joint portion and the minimum width of the necked portion are preferably in the above-mentioned numerical ranges and, as long as the maximum width thereof and the minimum width thereof fall within the above-mentioned numerical ranges, it is possible to reliably prevent the necked portion from being torn while more reliably preventing the situation in which the wrinkle occurs in the sheet.

In the above-mentioned structure, it is preferred that the necked portion of the coupling portion include an enlarged width portion having gradually enlarged in width from a most narrowed portion which is narrowest and being connected to a side of the joint portion.

That is, when the coupled plurality of sheets are rolled as the sheet roll, the rolling step is normally performed while the coupled plurality of sheets are transported in a predetermined direction using a plurality of rollers disposed in spaced apart relation (see FIG. 4 described later). Accordingly, there are cases where a situation in which the sheet end portion hangs down by its own weight between two adjacent rollers in a transport direction, and the portion of the sheet which hangs down interferes with the roller is created. Consequently, as in the above-mentioned structure, it is preferred to provide the enlarged width portion having gradually enlarged in width from the most narrowed portion and is connected to the side of the joint portion in the necked portion of the coupling portion, and the hanging-down of the sheet end portion is corrected using the enlarged width portion. That is, with this structure, as the sheet is transported, the enlarged width portion moves onto the roller while gradually increasing the area supported by the roller before the sheet edge reaches the roller. Then, a substantially entire width portion of the sheet end portion which hangs down by its own weight is smoothly pulled up onto the roller by the enlarged width portion having moved onto the roller, and hence it becomes possible to automatically correct the hanging-down of the sheet end portion.

In the above-mentioned structure, the plurality of sheets coupled together via the coupling portion may include a glass film having a thickness of 300 μm or less.

That is, the glass film described above is prone to breakage at the point when the deformation which forms the wrinkle in the end portion occurs by the tension generated during the rolling operation. Consequently, when the glass film is employed as the sheet, the operation and effect of the invention of the present application such that it is possible to reduce the wrinkle in the sheet end portion caused by the tension acting during the rolling operation as much as possible, become extremely useful.

In this case, it is preferred that each of widthwise both end surfaces of the glass film be formed of a laser-cleaved surface.

That is, according to the invention of the present application, as described above, it is possible to reduce the situation in which the wrinkle occurs in the glass film by the tension acting during the rolling operation as much as possible. Accordingly, in the case of a plurality of glass films coupled together via the coupling portion according to the invention of the present application, it is possible to execute laser cleaving on the coupled plurality of glass films with precision. Consequently, as in the above-mentioned structure, when the widthwise both end surfaces of the glass film are formed of the laser-cleaved surfaces, it is possible to reliably obtain high-strength end surfaces resulting from the laser cleaving.

The present invention devised in order to solve the above-mentioned problem relates to a sheet-like coupling member placed on end portions of two sheets so as to span therebetween and coupling the end portions of the two sheets together, the sheet-like coupling member including:

wide width portions each being joined to each of the two sheets to form a wide joint portion at each of both the end portions of the two sheets; and a necked portion, which is narrower than the wide width portions and is formed between the wide width portions.

When the sheet roll is manufactured by coupling the end portions of the plurality of sheets together by using the sheet-like coupling member having the above-mentioned structure, the above-mentioned operation and effect can be similarly obtained.

In the above-mentioned structure, it is preferred that the necked portion include an enlarged width portion having gradually enlarged in width from a most narrowed portion, which is narrowest and is connected to a side of the wide width portion.

Advantageous Effects of Invention

According to the present invention described above, in the sheet roll formed by coupling the plurality of sheets together and rolling the coupled plurality of sheets into the roll shape, it is possible to reliably prevent the situation in which the wrinkle occurs in the sheet by the tension acting during the rolling operation.

BRIEF DESCRIPTION OF DRAWINGS

FIG. 9(*b*) A view for illustrating the problem of the conventional sheet roll.

DESCRIPTION OF EMBODIMENTS

A description is given hereinbelow of embodiments of the present invention with reference to the accompanying drawings.

Figure 1:
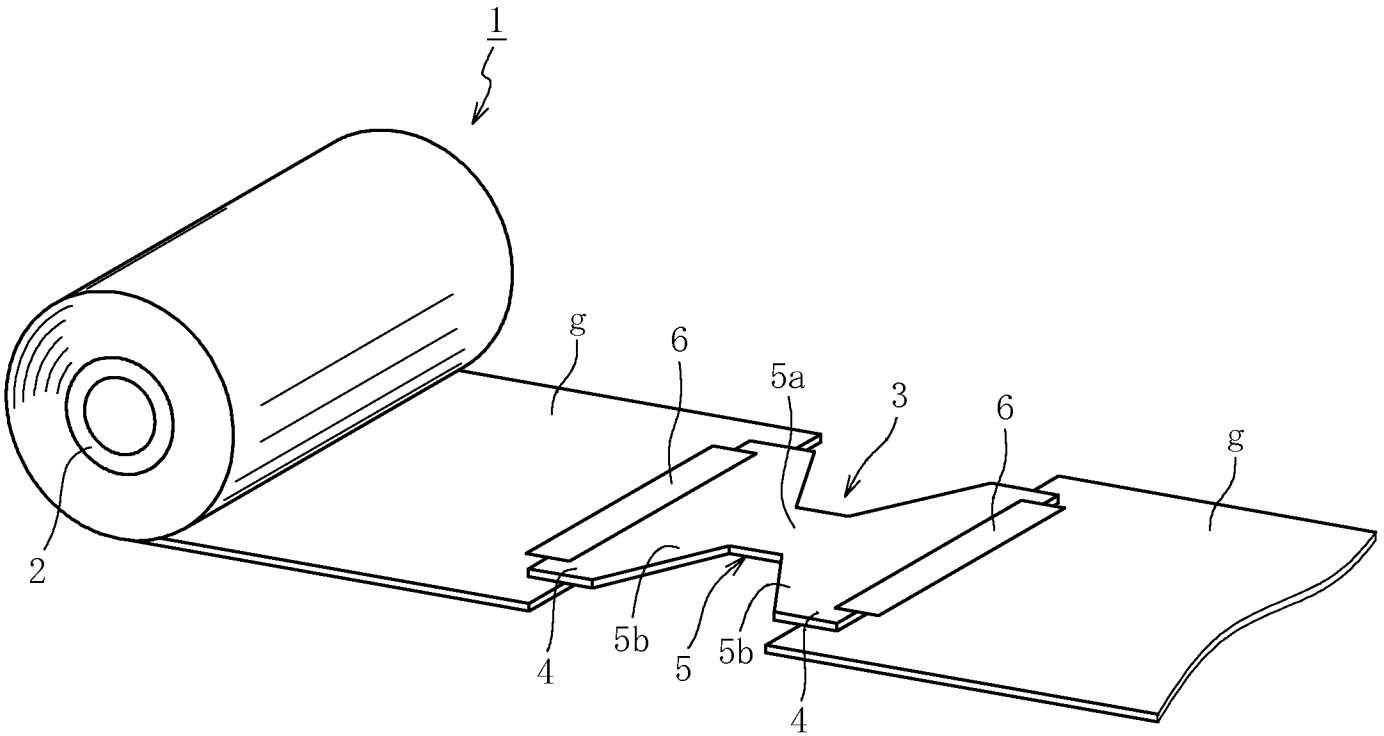
FIG. 1 A perspective view illustrating a sheet roll according to a first embodiment of the present invention.

FIG. 1 is a perspective view illustrating a sheet roll according to a first embodiment of the present invention. A sheet roll 1 is formed by coupling end portions of a plurality of long glass films g together to extend the length of the glass films g, and rolling the coupled plurality of glass films g around an external peripheral surface of a roll core 2 into a roll shape. Note that the thickness of the glass film g mentioned herein is 300 μm or less, the glass film g is glass formed by a down draw method such as an overflow down draw method or the like, and is used in, e.g., a flat panel display such as a liquid crystal display or an organic EL display, an organic EL illumination, and a solar cell.

The end portions of the two adjacent glass films g in a rolling direction are coupled together using a sheet-like coupling member 3. The sheet coupling body 3 is formed of a resin film such as a polyethylene terephthalate (PET) film or the like. In other words, the sheet-like coupling member 3 is a tough material having flexibility.

Specifically, the end portions of the two adjacent glass films g in the rolling direction are disposed in spaced apart relation, and the above-mentioned sheet-like coupling member 3 is placed on the end portions of the glass films g so as to span therebetween. In the sheet-like coupling member 3, both end portions in the rolling direction are formed into wide width portions 4, and a middle portion in the rolling direction is formed into a necked portion 5 which is narrower than the wide width portions 4. In this embodiment, each of the wide-width portions 4 formed at each of the both end portions of the sheet-like coupling member 3 is joined to the glass film g using adhesive tape (single-sided adhesive tape) 6 which is attached onto the wide-width portion 4 and the glass film g so as to extend over them in a state where the wide-width portion 4 overlaps the end portion of the glass film g. That is, areas to which the adhesive tape 6 is attached function as joint portions. With this structure, the necked portion 5 of the sheet-like coupling member 3 serves as an actively deforming part, and hence, even when tension acts on the glass films g during a rolling operation and the misalignment of widthwise center lines of the glass films g is thereby corrected, the necked portion 5 of the sheet-like coupling member 3 actively deforms, and unreasonable deformation becomes less likely to occur in the glass films g themselves. In addition, the sheet-like coupling member 3 includes the wide joint portions (the areas corresponding to the adhesive tape 6), and hence the tension acting on the individual glass films g acts on widthwise wide ranges (substantially entire widthwise areas) of the end portions of the glass films g so that a situation in which the tension locally acts only on widthwise narrow ranges of the end portions of the glass films g and wrinkles are formed around the joint portions is less likely to be created. Moreover, the end portions of the glass films g are preliminarily reinforced by the wide joint portions of the sheet-like coupling member 3 so that the deformation is less likely to occur, and hence it is possible to reduce the wrinkle formed in the end portions of the glass films g as much as possible.

Figure 2:
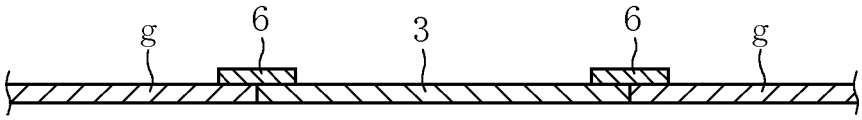
FIG. 2 A longitudinal sectional view illustrating a modification of a joining method of a sheet-like coupling member and a glass film in a sheet coupling portion of FIG. 1.

The joining method of the sheet-like coupling member 3 and the glass films g is not limited to the method in which the single-sided adhesive tape 6 is attached onto the wide-width portions 4 and the glass films g so as to extend over them in the state where the wide-width portions 4 of the sheet-like coupling member 3 overlap the end portions of the glass films g, and overlapping portions of the wide-width portions 4 and the end portions of the glass films g may be bonded to each other using double-sided adhesive tape or an adhesive, or may be thermally welded to each other. In addition, as illustrated in FIG. 2, a method may also be employed in which the adhesive tape 6 is attached onto the glass films g and the sheet-like coupling member 3 so as to extend over them in the state where the edges of the glass films g and the sheet-like coupling member 3 are caused to butt against each other or disposed close to each other.

Figure 3:
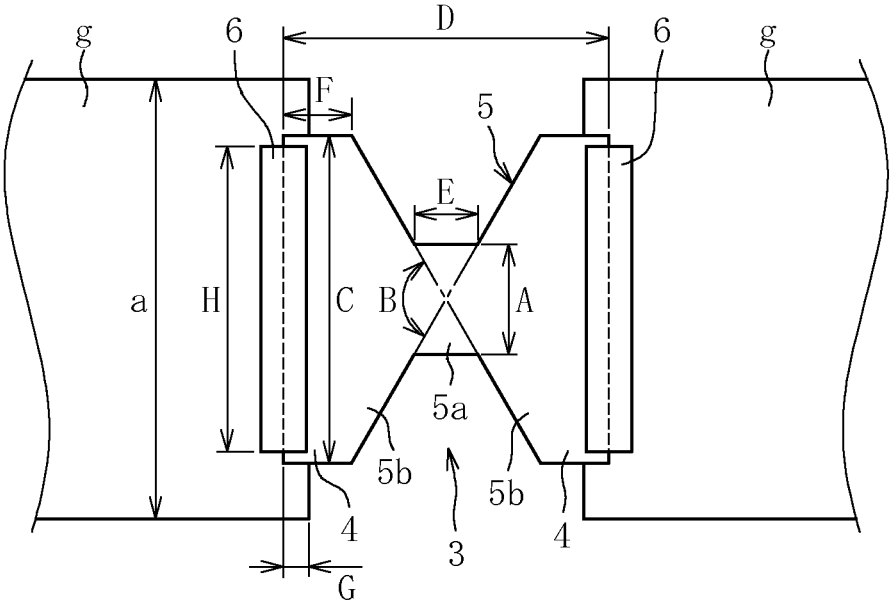
FIG. 3 A plan view illustrating the sheet coupling portion of FIG. 1.

As illustrated in FIG. 3, the necked portion 5 of the sheet-like coupling member 3 includes enlarged width portions 5*b* which are gradually widened widthwise from a most narrowed portion 5*a* as the narrowest portion and connected to the wide-width portions 4. With this structure, even when the end portion of the glass film g hangs down by its own weight between rollers which transport the glass film g in the step of rolling the coupled plurality of glass films g, the enlarged width portion 5*b* moves onto the roller while gradually increasing an area supported by the roller before the end portion of the glass film g reaches the roller. Subsequently, by the enlarged width portion 5*b* having moved onto the roller in this manner, a substantially entire width portion of the end portion of the glass film g which hangs down is smoothly pulled up onto the roller, and hence it is possible to automatically correct the hanging-down of the end portion of the glass film g.

In addition, in this embodiment, each of the enlarged width portions 5*b* is formed of a tapered member in which both end portion sides are inclined outward in the width direction from a central portion side. The tapered members positioned diagonally opposite to each other with the most narrowed portion 5*a* disposed therebetween are positioned on the same straight line. When the tapered members are positioned on the same straight line in this manner, balance of the tension acting on the glass films g on both sides of the most narrowed portion 5*a* is improved, and an advantage can be obtained that the behavior of the sheet-like coupling member 3 when passing on the transport rollers described later is stabilized.

Next, on the basis of FIG. 3, a description is given of preferable modes of dimensional relationship between the individual portions of the sheet-like coupling member 3 and the glass film g.

A widthwise dimension A of the most narrowed portion 5*a* in the necked portion 5 of the sheet-like coupling member 3 is preferably in a range of 5% to 70% of a widthwise dimension a of the glass film g, more preferably in a range of 8% to 50% thereof, and most preferably in a range of 10% to 20%. That is, when the widthwise dimension A of the most narrowed portion 5*a* is excessively large, the effect of absorbing deformation by torsional deformation or the like of the sheet-like coupling member 3 is reduced so that the glass film g may also be deformed. On the other hand, when the widthwise dimension A of the most narrowed portion 5*a* is excessively small, the most narrowed portion 5*a* of the necked portion 5 can not withstand the tension acting during the rolling operation so that the most narrowed portion 5*a* may be torn. Consequently, the widthwise dimension A of the most narrowed portion 5*a* is preferably in the above-mentioned numerical ranges, and the above-mentioned troubles can be reliably avoided as long as the widthwise dimension A falls within the above-mentioned ranges.

An angle B formed by the tapered member of the enlarged width portion 5*b* in the necked portion 5 of the sheet-like coupling member 3 is preferably in a range of 90 to 150°, and more preferably in a range of 110 to 130°. That is, when the angle B formed by the tapered member of the enlarged width portion 5*b* is excessively large, the function of correcting the hanging-down of the end portion of the glass film g by the enlarged width portion 5*b* may be lowered. On the other hand, when the angle B formed by the tapered member of the enlarged width portion 5*b* is excessively small, depressions on both sides of the necked portion 5 become gentle so that the effect of absorbing deformation by the necked portion 5*b* may be lowered. Consequently, the angle B formed by the tapered member of the enlarged width portion 5*b* is preferably in the above-mentioned numerical ranges, and the above-mentioned troubles can be reliably avoided as long as the angle B falls within the above-mentioned ranges.

A maximum widthwise dimension C of the wide-width portion 4 of the sheet-like coupling member 3 is preferably 80% or more of the widthwise dimension a of the glass film g, and more preferably 90% or more thereof. That is, when the maximum widthwise dimension C of the wide-width portion 4 is excessively small, both widthwise sides of the glass film g hang down so that they may come in contact with the roller. Consequently, the maximum widthwise dimension C of the wide-width portion 4 is preferably in the above-mentioned numerical ranges, and the above-mentioned trouble can be reliably avoided as long as the maximum widthwise dimension C falls within the above-mentioned ranges. Note that an upper limit value of the maximum widthwise dimension C of the wide-width portion 4 can exceed 100% of the widthwise dimension a of the glass film g. However, in this case, the sheet-like coupling member 3 extends off both widthwise sides of the sheet roll 1, and hence the upper limit value is preferably 100% or less of the widthwise dimension a of the glass film g in terms of prevention of the extending-off. In addition, as described later, when both widthwise end portions of the glass film g are cut by laser cleaving, it is preferred to appropriately adjust the above-mentioned numerical range of the maximum widthwise dimension C of the wide-width portion 4 of the sheet-like coupling member 3 within a range in which the sheet-like coupling member 3 does not extend over a scheduled cleaving line by laser cleaving.

A rolling-direction dimension D of the sheet-like coupling member 3 is preferably in a range of 30% to 200% of the widthwise dimension a of the glass film g. That is, when the rolling-direction dimension D of the sheet-like coupling member 3 is excessively large, large work space is required in order to attach the sheet-like coupling member 3 to the end portions of the glass films g. On the other hand, when the rolling-direction dimension D of the sheet-like coupling member 3 is excessively small, the deformation can not be absorbed by the necked portion 5 completely so that the glass film g may also be deformed. Consequently, the rolling-direction dimension D of the sheet-like coupling member 3 is preferably in the above-mentioned numerical range, and the above-mentioned troubles can be reliably avoided as long as the rolling-direction dimension D falls within the above-mentioned range.

A rolling-direction dimension E of the most narrowed portion 5*a* in the necked portion 5 of the sheet-like coupling member 3 is preferably in a range of 5% to 100% of the widthwise dimension a of the glass film g. That is, when the rolling-direction dimension E of the most narrowed portion 5*a* is excessively large, large work space is required in order to attach the sheet-like coupling member 3 to the end portions of the glass films g. On the other hand, when the rolling-direction dimension E of the most narrowed portion 5*a* is excessively small, it is not possible to sufficiently secure an area of a deformation absorption region of the necked portion 5 so that the glass film g may also be deformed. Consequently, the rolling-direction dimension E of the most narrowed portion 5*a* is preferably in the above-mentioned numerical range, and the above-mentioned troubles can be reliably avoided as long as the rolling-direction dimension E falls within the above-mentioned range.

A rolling-direction dimension F of the wide-width portion 4 of the sheet-like coupling member 3 is preferably in a range of 0% to 10% of the widthwise dimension a of the glass film g. That is, when the rolling-direction dimension F of the wide-width portion 4 is excessively large, torsion occurs between the glass film g and the sheet-like coupling member 3 so that the wrinkle may occur in the glass film g. Consequently, the rolling-direction dimension F of the wide-width portion 4 is preferably in the above-mentioned numerical range, and the above-mentioned trouble can be reliably avoided as long as the rolling-direction dimension F falls within the above-mentioned range.

A rolling-direction dimension G of the overlapping portions of the wide-width portion 4 of the sheet-like coupling member 3 and the glass film g is preferably in a range of 0% to 5% of the widthwise dimension a of the glass film g. That is, when the rolling-direction dimension G of the overlapping portion of the wide-width portion 4 and the glass film g is excessively large, for example, depending on a joining mode such as formation of the joint portion using one-sided adhesive tape or the like, the end portion of the glass film g hangs down so that the end portion thereof may come in contact with the roller. Consequently, the rolling-direction dimension G of the overlapping portion of the wide-width portion 4 and the glass film g is preferably in the above-mentioned numerical range, and the above-mentioned trouble can be reliably avoided as long as the rolling-direction dimension G falls within the above-mentioned range.

A widthwise dimension H of the joint portion to which the adhesive tape 6 is attached is preferably in a range of 80% to 100% of the widthwise dimension a of the glass film g. That is, when the widthwise dimension H of the joint portion is excessively small, the wrinkle may occur around the joint portion of the glass film g. In addition, both widthwise sides of the glass film g hang down so that they may come in contact with the roller. Consequently, the widthwise dimension H of the joint portion is preferably in the above-mentioned numerical range, and the above-mentioned troubles can be reliably avoided as long as the widthwise dimension H falls within the above-mentioned range.

Next, a description is given of an example of manufacturing steps of the sheet roll 1 according to the first embodiment.

Figure 4:
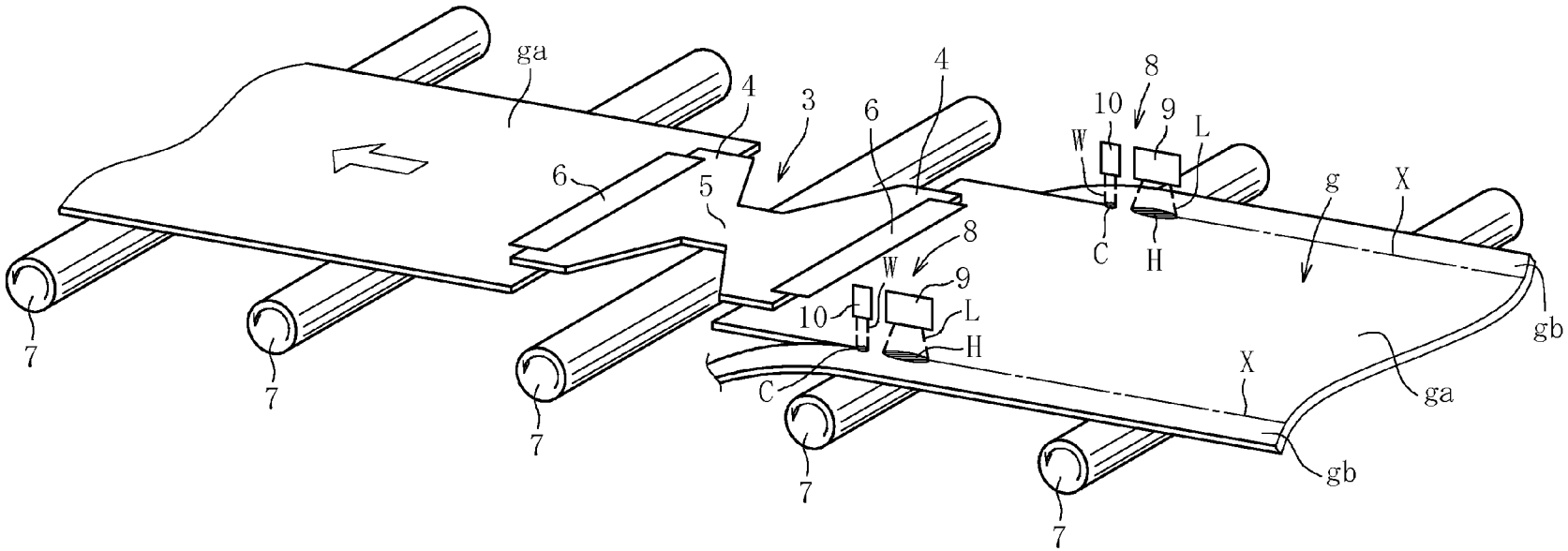
FIG. 4 A perspective view illustrating an example of a rolling step of the sheet roll of FIG. 1.

As illustrated in FIG. 1, the sheet roll 1 is manufactured by rolling the plurality of glass films g coupled together using the sheet-like coupling member 3 around the outer peripheral surface of the roll core 2. As illustrated in FIG. 4, the step of rolling the glass films g is performed while the plurality of glass films g coupled together using the sheet-like coupling member 3 are transported in a predetermined direction using a plurality of rollers 7. Subsequently, on the most downstream side in a transport direction outside the drawing, the plurality of glass films g are sequentially rolled, and the sheet roll 1 is thereby manufactured.

On the other hand, on the most upstream side in the transport direction, there is disposed a forming device for continuously forming the glass film g, or another sheet roll around which a preformed glass film g is rolled.

Herein, in the case of the former, both widthwise end portions of the glass film g are held by holding means such as the roller or the like and pulled in a forming process, and hence there is possibility that invisible minute flaws resulting from the contact with the holding means are present on the both widthwise end portions. Accordingly, it becomes necessary to cut off the both widthwise end portions of the glass film g on which contact portions with the holding means are formed as unnecessary portions gb. Further, in the case of the latter, when the glass film g unrolled from the sheet roll separately disposed on the upstream side is formed with the contact portions with the above-mentioned holding means, it becomes necessary to cut off the contact portions as the unnecessary portions gb and, even when the contact portions do not exist as a result of cutting or the like, if the dimension of the glass film g is larger than a required dimension of a product, it becomes necessary to cut off the both widthwise end portions of the glass film g as the unnecessary portions gb.

Accordingly, in the rolling step illustrated in FIG. 4, the unnecessary portions gb of the both widthwise end portions of the glass film g are cut off on the transport path of the glass film g using cleaving devices 8, the cut unnecessary portions gb are deviated from the track of an effective portion ga while being bent downward, and are disposed of. At this point, the sheet-like coupling member 3 is positioned so as to remain within the effective portion ga defined by scheduled cleaving lines X of the glass film g.

Each of the cleaving devices 8 includes heating means 9 for emitting a laser beam L from above-mentioned the glass film g to perform local heating, and cooling means 10 for spraying a cooling water W to a heated region H heated by the heating means 9 from the front surface side. With this, the heated region H heated by the heating means 9 and a cooled region C cooled by the cooling means 10 move on the scheduled cleaving lines X of the glass film g as the glass film g is transported, and a thermal stress acts along the scheduled cleaving lines X. At the tip portion of each of the scheduled cleaving lines X, an initial crack which is not shown is preformed, the initial crack develops by the thermal stress along the scheduled cleaving line X, and the glass film g is thereby cleaved. At this point, even when the tension acts on the glass film g by the operation of the sheet-like coupling member 3, the wrinkle is less likely to occur in the glass film g, and hence it is possible to execute the laser cleaving on the glass film g with precision. Consequently, widthwise both end surfaces of the glass film g included in the sheet roll 1 which is manufactured through the above-mentioned cleaving step become high-strength surfaces having few minute cracks resulting in breakage because of the laser cleaving.

Figure 5:
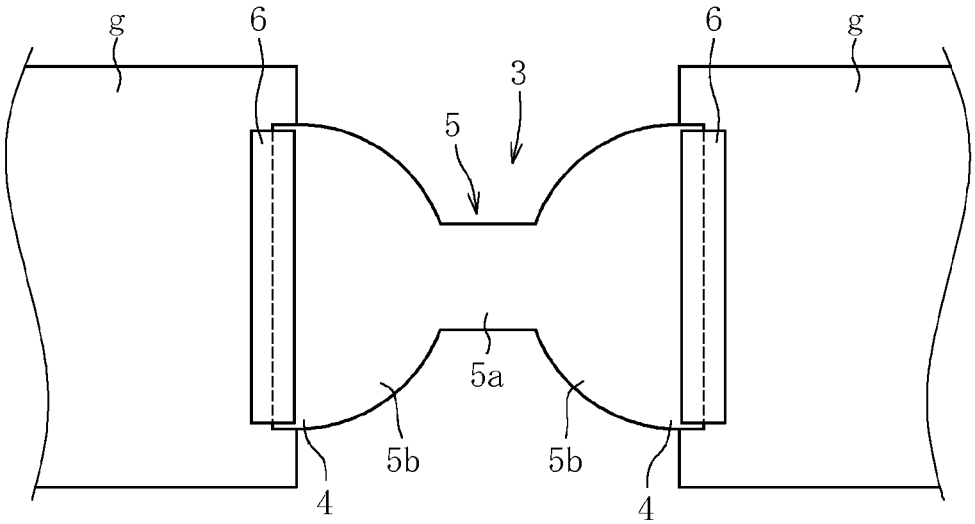
FIG. 5 A plan view illustrating a sheet coupling portion of a sheet roll according to a second embodiment.

FIG. 5 is a plan view illustrating a coupling portion of a sheet roll according to a second embodiment of the present invention. The coupling portion according to the second embodiment is different from the coupling portion according to the first embodiment in that each of the enlarged width portions 5*b* connecting between the most narrowed portion 5*a* and the wide-width portion 4 of the sheet-like coupling member 3 is not formed into a tapered shape but is formed of convex curves. Note that the enlarged width portion 5*b* may also be formed of concave curves.

Figure 6:
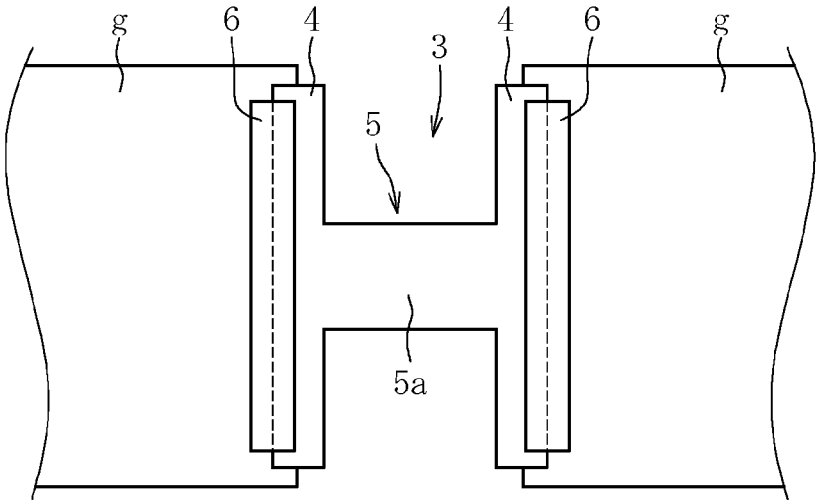
FIG. 6 A plan view illustrating a sheet coupling portion of a sheet roll according to a third embodiment.

FIG. 6 is a plan view illustrating a coupling portion of a sheet roll according to a third embodiment of the present invention. The coupling portion according to the third embodiment is different from the coupling portion according to the first embodiment in that the enlarged width portions 5*b* of the sheet-like coupling member 3 are omitted, and each of the wide-width portions 4 is directly connected to the narrow-width portion (the most narrowed portion) 5*a* in the sheet-like coupling member 3.

Figure 7:
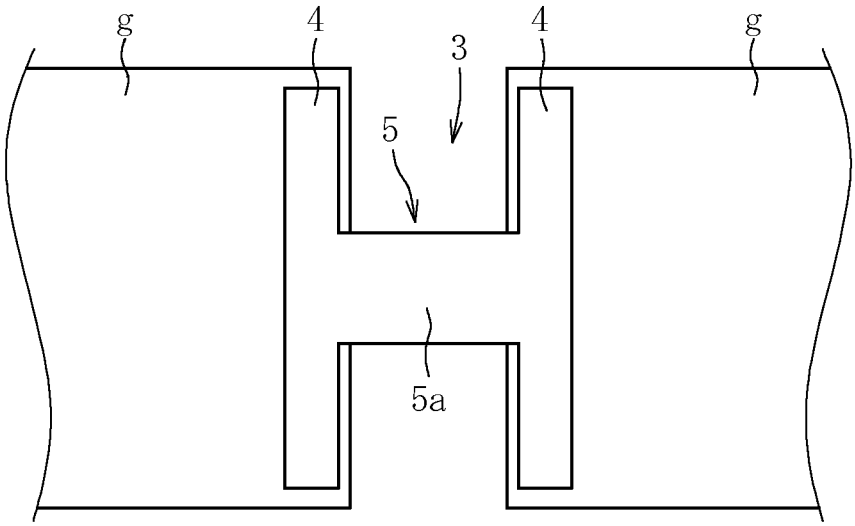
FIG. 7 A plan view illustrating a sheet coupling portion of a sheet roll according to a fourth embodiment.

FIG. 7 is a plan view illustrating a coupling portion of a sheet roll according to a fourth embodiment of the present invention. The coupling portion according to the fourth embodiment is different from the coupling portion according to the third embodiment in that the entire wide-width portions 4 of the sheet-like coupling member 3 composed only of the narrow-width portion 5*a* and the wide-width portions 4 are placed on the end portions of the glass films g to be joined to the glass films g.

Figure 8:
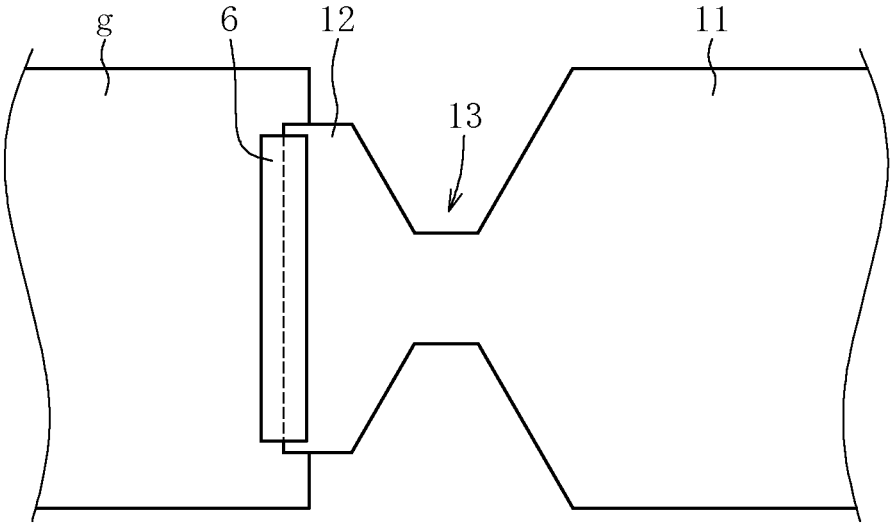
FIG. 8 A plan view illustrating a sheet coupling portion of a sheet roll according to a fifth embodiment.
Figure 9A:
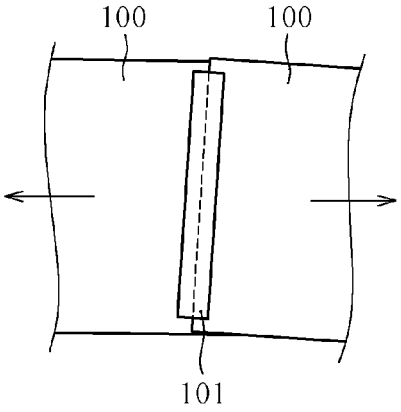
FIG. 9(*a*) A view for illustrating a problem of a conventional sheet roll.
Figure 9B:
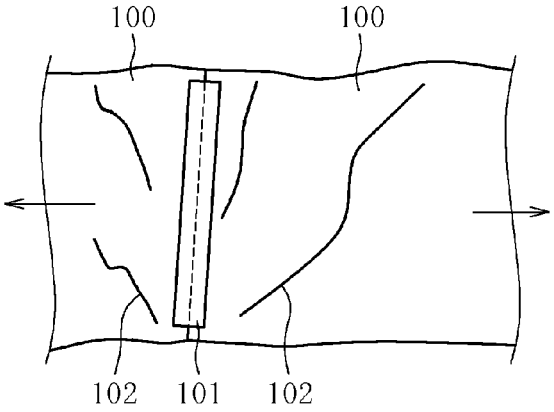
Figure 10:
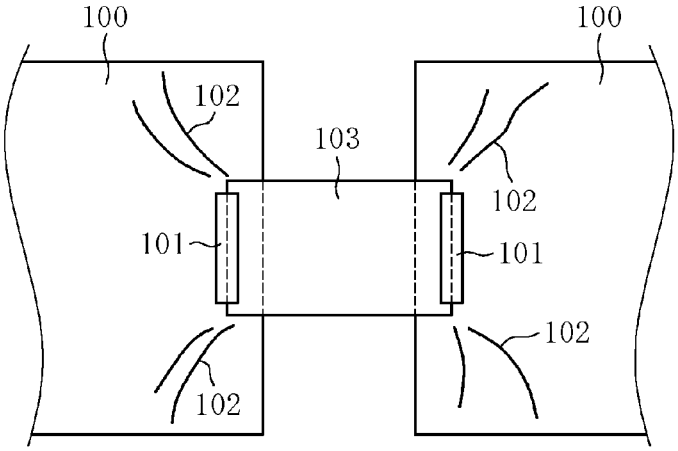
FIG. 10 A view for illustrating a problem of a sheet roll invented by the present inventors before the invention of the present application.

FIG. 8 is a plan view illustrating a coupling portion of a sheet roll according to a fifth embodiment of the present invention. The coupling portion according to the fifth embodiment is different from the coupling portion according to each of the first to fourth embodiments in that, instead of coupling the glass films g together, a resin film 11 with which the coupling portion is integrally formed is coupled to the glass film g. Specifically, the resin film 11 includes a wide wide-width portion 12 which forms the joint portion with the end portion of the glass film g at an end portion in the rolling direction, and a necked portion 13 which is narrower than the wide-width portion 12 in a partial area in the vicinity of the wide-width portion 12. Thus, even when the coupling portion is integrally formed with the resin film 11, it is possible to reduce the situation in which the wrinkle occurs in the glass film g similarly.

Note that the present invention is not limited to the above-mentioned embodiments, and various modifications can be made. For example, although the description has been given of the case where the glass films g are coupled together via the sheet-like coupling member 3 in each of the above-mentioned embodiments, a structure may also be employed in which the glass film and the resin film, or the resin films are coupled together via the sheet-like coupling member 3.

In addition, a structure may also be employed in which the resin film is coupled to the leading end and the terminal end of the sheet (the glass film g or the like) included in the sheet roll 1 in the rolling direction in any one of the modes described in the above-mentioned embodiments, and the resin film is used as the leader when the sheet is guided into a roll-to-roll device.

REFERENCE SIGNS LIST

1 sheet roll
2 roll core
3 sheet-like coupling member
4 wide width portion
5 necked portion
5*a* most narrowed portion
5*b* enlarged width portion
6 adhesive tape
7 roller
8 cleaving device
9 heating means
10 cooling means
11 resin film
12 wide width portion
13 necked portion
g glass film

The invention claimed is:

1. A sheet roll comprising:

two glass films; and a sheet-like coupling member, wherein end portions of the glass films are coupled together via the sheet-like coupling member, and the coupled glass films are rolled into a roll shape, wherein the sheet-like coupling member is formed of a resin and placed on the end portions of the two glass films in a rolling direction so as to span therebetween, wherein the sheet-like coupling member includes:

(i) wide width portions which are formed at both end portions of the sheet-like coupling member in the rolling direction; and (ii) a necked portion which is narrower than the wide width portions and is formed at a middle portion of the sheet-like coupling member in the rolling direction, wherein the wide width portions are joined respectively to the end portions of the two glass films using adhesive tape which is wider than the necked portion, wherein a rolling direction length of each of the wide width portions is in a range of 0% to 10% of a maximum width of the glass films, wherein a rolling direction length of the sheet-like coupling member is in a range of 30% to 200% of the maximum width of the glass films, wherein a maximum width of each of the wide width portions is 80% or more of the maximum width of the glass films, and each of the glass films is wider than the wide width portions and extends beyond both sides in the width direction of the wide width portions, wherein a maximum width of the adhesive tape which joins the end portions of the two glass films to the wide width portions, respectively, is 80% or more of the maximum width of the glass films, and each of the glass films is wider than the adhesive tape and extends beyond both sides in the width direction of the adhesive tape, wherein the necked portion of the sheet-like coupling member comprises a most narrowed portion and enlarged width portions at opposing ends of the most narrowed portion in the rolling direction, the most narrowed portion being a narrowest part of the sheet-like coupling member, wherein the enlarged width portions are gradually widened widthwise in directions away from the most narrowed portion, such that each of the enlarged width portions constitutes a tapered part having widthwise opposing side edges that are inclined widthwise outwardly away from each other along the rolling direction away from the most narrowed portion, wherein the opposing side edges of a first one of the tapered parts comprise a first inclined side edge on a first widthwise side of the sheet-like coupling member, and a second inclined side edge on a second widthwise side of the sheet-like coupling member opposite the first widthwise side, wherein the opposing side edges of a second one of the tapered parts comprise a first inclined side edge on the first widthwise side of the sheet-like coupling member, and a second inclined side edge on the second widthwise side of the sheet-like coupling member opposite the first widthwise side, wherein the first inclined side edge of the first tapered part and the second inclined side edge of the second tapered part are disposed diagonally opposite one another and both extend along a single first straight line, and wherein the first inclined side edge of the second tapered part and the second inclined side edge of the first tapered part are disposed diagonally opposite one another and both extend along a single second straight line.

2. The sheet roll of claim 1, wherein a maximum width of each of the wide width portions is in a range of from 80% to 100% of the maximum width of the glass films, and wherein a minimum width of the necked portion is in a range of from 5% to 70% of the maximum width of the glass films.

3. The sheet roll of claim 2, wherein each of the glass films has a thickness of 300 μm or less.

4. The sheet roll of claim 1, wherein the glass films have a thickness of 300 μm or less.

5. The sheet roll of claim 1, wherein each of the glass films has end surfaces in a width direction which are formed of a laser cleaved surface.

6. A sheet roll comprising:

a glass film;

a resin film; and a sheet-like coupling member, wherein an end portion of the glass film and an end portion of the resin film are coupled together via the sheet-like coupling member, and the coupled films are rolled into a roll shape, wherein the sheet-like coupling member is formed of a resin and placed on the end portions of the films in a rolling direction so as to span therebetween, wherein the sheet-like coupling member includes:

(i) wide width portions which are formed at both end portions of the sheet-like coupling member in the rolling direction; and (ii) a necked portion which is narrower than the wide width portions and is formed at a middle portion of the sheet-like coupling member in the rolling direction, wherein the wide width portions are joined respectively to the end portions of the films using adhesive tape which is wider than the necked portion, wherein a rolling direction length of each of the wide width portions is in a range of from 0% to 10% of a maximum width of the films, and wherein a rolling direction length of the sheet-like coupling member is in a range of from 30% to 200% of the maximum width of the films, wherein a maximum width of each of the wide width portions is 80% or more of the maximum width of the films, and each of the films is wider than the wide width portions and extends beyond both sides in the width direction of the wide width portions, and wherein a maximum width of the adhesive tape which joins the end portions of the films to the wide width portions, respectively, is 80% or more of the maximum width of the films, and each of the films is wider than the adhesive tape and extends beyond both sides in the width direction of the adhesive tape, wherein the necked portion of the sheet-like coupling member comprises a most narrowed portion and enlarged width portions at opposing ends of the most narrowed portion in the rolling direction, the most narrowed portion being a narrowest part of the sheet-like coupling member, wherein the enlarged width portions are gradually widened widthwise in directions away from the most narrowed portion, such that each of the enlarged width portions constitutes a tapered part having widthwise opposing side edges that are inclined widthwise outwardly away from each other along the rolling direction away from the most narrowed portion, wherein the opposing side edges of a first one of the tapered parts comprise a first inclined side edge on a first widthwise side of the sheet-like coupling member, and a second inclined side edge on a second widthwise side of the sheet-like coupling member opposite the first widthwise side, wherein the opposing side edges of a second one of the tapered parts comprise a first inclined side edge on the first widthwise side of the sheet-like coupling member, and a second inclined side edge on the second widthwise side of the sheet-like coupling member opposite the first widthwise side, wherein the first inclined side edge of the first tapered part and the second inclined side edge of the second tapered part are disposed diagonally opposite one another and both extend along a single first straight line, and wherein the first inclined side edge of the second tapered part and the second inclined side edge of the first tapered part are disposed diagonally opposite one another and both extend along a single second straight line.

7. The sheet roll of claim 6, wherein a maximum width of each of the wide width portions is in a range of from 80% to 100% of the maximum width of the films, and wherein a minimum width of the necked portion is in a range of from 5% to 70% of the maximum width of the films.

8. The sheet roll of claim 7, wherein the glass film has a thickness of 300 μm or less.

9. The sheet roll of claim 6, wherein the glass film has a thickness of 300 μm or less.

10. The sheet roll of claim 6, wherein the glass film has end surfaces in a width direction which are formed of a laser cleaved surface.

* * * * *